US011668181B2

(12) United States Patent
Alarawi et al.

(10) Patent No.: US 11,668,181 B2
(45) Date of Patent: Jun. 6, 2023

(54) SMART SENSING DRILL BIT FOR MEASURING THE RESERVOIR'S PARAMETERS WHILE DRILLING

(71) Applicants: SAUDI ARABIAN OIL COMPANY, Dhahran (SA); KING ABDULAZIZ CITY FOR SCIENCE AND TECHNOLOGY, Riyadh (SA)

(72) Inventors: Abeer Ateeq Alarawi, Al Khobar (SA); Masfer Alkahtani, Riyadh (SA); Abdullah Al Moajil, Eastern Region (SA); Sajjad Al Darweesh, Safwa (SA)

(73) Assignees: SAUDI ARABIAN OIL COMPANY, Dhahran (SA); KING ABDULAZIZ CITY FOR SCIENCE AND TECHNOLOGY, Riyadh (SA)

( * ) Notice: Subject to any disclaimer, the term of this patent is extended or adjusted under 35 U.S.C. 154(b) by 0 days.

(21) Appl. No.: 17/491,273

(22) Filed: Sep. 30, 2021

(65) Prior Publication Data

US 2023/0099562 A1 Mar. 30, 2023

(51) Int. Cl.
*E21B 47/002* (2012.01)
*E21B 47/013* (2012.01)
(Continued)

(52) U.S. Cl.
CPC ..... *E21B 47/002* (2020.05); *E21B 47/006* (2020.05); *E21B 47/013* (2020.05); *E21B 47/07* (2020.05); *E21B 47/135* (2020.05)

(58) Field of Classification Search
CPC .... E21B 47/002; E21B 47/006; E21B 47/013; E21B 47/07; E21B 47/135
See application file for complete search history.

(56) References Cited

U.S. PATENT DOCUMENTS 3,170,137 A * 2/1965 Brandt ..... G01V 3/34 340/855.1
7,954,560 B2 6/2011 Mathiszik et al.
(Continued)

FOREIGN PATENT DOCUMENTS

WO 2020205460 A1 10/2020

OTHER PUBLICATIONS

Llera, M., Tow, K., Bergerat, S., Meyer, Y., Monnerat, S., Gloriod, O., Floch, S., Salvadé, Y. and Thévenaz, L., "Fiber Bragg Grating-Based Thermometer for Drill Bit Temperature Monitoring", Applied Optics, vol. 58, No. 22, Aug. 2019 (7 pages).
(Continued)

*Primary Examiner* — D. Andrews
*Assistant Examiner* — Yanick A Akaragwe
(74) *Attorney, Agent, or Firm* — Osha Bergman Watanabe & Burton LLP

(57) ABSTRACT

A drill bit for drilling a subterranean formation. The drill bit includes a drill bit body, at least one cutting element disposed on the drill bit body, and an optical sensor disposed on the drill bit body and configured to generate an environmental parameter measurement while drilling the subterranean formation. The optical sensor includes a fiber bragg grating embedded in an optical fiber that passes through a first channel in the drill bit body and a second channel in the drill string to couple to a surface logging station for analyzing the environmental parameter measurement, where the environmental parameter measurement represents at least a downhole chemical composition measured by the fiber bragg grating, and an analysis result of the surface logging station is presented to a user to facilitate a drilling operation.

15 Claims, 5 Drawing Sheets

(51) Int. Cl.

| | |
|---|---|
| ***E21B 47/00*** | (2012.01) |
| ***E21B 47/135*** | (2012.01) |
| ***E21B 47/07*** | (2012.01) |

(56) References Cited

U.S. PATENT DOCUMENTS

| | | | | |
|---|---|---|---|---|
| 8,087,477 | B2 | 1/2012 | Sullivan et al. | |
| 9,075,155 | B2 | 7/2015 | Luscombe et al. | |
| 9,885,234 | B2 | 2/2018 | Pelletier et al. | |
| 2010/0282510 | A1* | 11/2010 | Sullivan | E21B 10/00 73/152.43 |
| 2014/0246235 | A1 | 9/2014 | Yao | |
| 2018/0230049 | A1* | 8/2018 | Wysocki | C03C 25/6208 |
| 2020/0308954 | A1* | 10/2020 | Hird | E21B 47/007 |

OTHER PUBLICATIONS

Ahmed, T., & Hossain, M., "Methods of Oil Drilling Sensor for High Temperature and Vibrations", International Journal of Scientific and Research Publications (IJSRP), vol. 8, No. 11, Nov. 2018 (8 pages).

Gravley, W., "Review of Downhole Measurement-While-Drilling Systems", Journal of Petroleum Technology, vol. 35, No. 08, pp. 1439-1445, Aug. 1983 (7 pages).

* cited by examiner

SMART SENSING DRILL BIT FOR MEASURING THE RESERVOIR'S PARAMETERS WHILE DRILLING

BACKGROUND

Sensors are used for oil and gas well applications to reach multiple kilometers into the subsurface and measure a wide range of parameters such as pressure and temperature distributions along the well. The working mechanism relies on detecting acoustic signals from the seismic activities in the well-bore and the mechanical stress on structural components. A range of different sensors may be used, either temporarily hung-off in the well or permanently installed as part of the well construction. The sensors in the downhole environment are subject to considerable temperatures and pressures (e.g., 85° C. and 200 bars in a 2 km deep well), as well as aggressive chemicals (e.g., Hydrogen-sulfide ($H_2S$)). For example, for enhanced oil recovery, steam or chemicals are often injected to reduce oil viscosity and hence improve flow towards production wells. Steam temperatures downhole may increase above 200° C. with elevated pressure, where chemical surfactants are strongly acidic or basic.

SUMMARY

In general, in one aspect, the invention relates to a drill bit for drilling a subterranean formation. The drill bit includes a drill bit body, at least one cutting element disposed on the drill bit body, and an optical sensor disposed on the drill bit body and configured to generate an environmental parameter measurement while drilling the subterranean formation, the optical sensor comprising a first fiber bragg grating embedded in at least one optical fiber, the drill bit body adapted for coupling to a drill string and comprising a first channel for passing the at least one optical fiber into a second channel in the drill string, wherein the at least one optical fiber is adapted to pass through the first channel and the second channel to couple to a surface logging station for analyzing the environmental parameter measurement, wherein the environmental parameter measurement represents at least a downhole chemical composition measured by the first fiber bragg grating, and wherein an analysis result of the surface logging station is presented to a user to facilitate a drilling operation.

In general, in one aspect, the invention relates to a well system for performing a drilling operation of a subterranean formation. The well system includes a drill bit coupled to a drill string that is suspended in a wellbore penetrating the subterranean formation, and a surface logging station coupled to the drill bit via at least one optical fiber and configured to analyze an environmental parameter measurement inside the wellbore, wherein the drill bit comprises a drill bit body, at least one cutting element disposed on the drill bit body, and an optical sensor disposed on the drill bit body and configured to generate an environmental parameter measurement while drilling the subterranean formation, the optical sensor comprising a first fiber bragg grating embedded in at least one optical fiber, the drill bit body adapted for coupling to the drill string and comprising a first channel for passing the at least one optical fiber into a second channel in the drill string, wherein the at least one optical fiber is adapted to pass through the first channel and the second channel to couple to the surface logging station, wherein the environmental parameter measurement represents at least a downhole chemical composition measured by the first fiber bragg grating, and wherein an analysis result of the surface logging station is presented to a user to facilitate the drilling operation.

In general, in one aspect, the invention relates to a method for performing a drilling operation of a subterranean formation. The method includes disposing an optical sensor on a drill bit body of a drill bit, wherein the drill bit is coupled to a drill string that is suspended in a wellbore penetrating the subterranean formation, the optical sensor comprising a fiber bragg grating embedded in at least one optical fiber, generating, by the optical sensor while drilling the subterranean formation using the drill bit, an environmental parameter measurement inside the wellbore, transmitting, via the at least one optical fiber, the environmental parameter measurement to a surface logging station, generating, by the surface logging station, an analysis result by analyzing the environmental parameter measurement, and presenting the analysis result to a user to facilitate the drilling operation, wherein the environmental parameter measurement represents at least a downhole chemical composition measured by the first fiber bragg grating.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of this disclosure provide a smart sensing drill bit for drilling a subterranean formation. The drill bit includes a drill bit body, at least one cutting element disposed on the drill bit body, and one or more optical sensors disposed on the drill bit body and is configured to generate an environmental parameter measurement while drilling the subterranean formation. In one or more embodiments, the optical sensor includes a fiber bragg grating embedded in an optical fiber. The drill bit body is adapted to couple to a drill string and includes a first channel for passing the optical fiber into a second channel in the drill string. The optical fiber is adapted to pass through the first channel and the second channel to couple to a surface logging station that analyzes the environmental parameter measurement. In one or more embodiments, the environmental parameter measurement represents at least a downhole chemical composition measured by the fiber bragg grating. Accordingly, an analysis result of the surface logging station is presented to a user to facilitate the drilling operation.

Figure 1A:
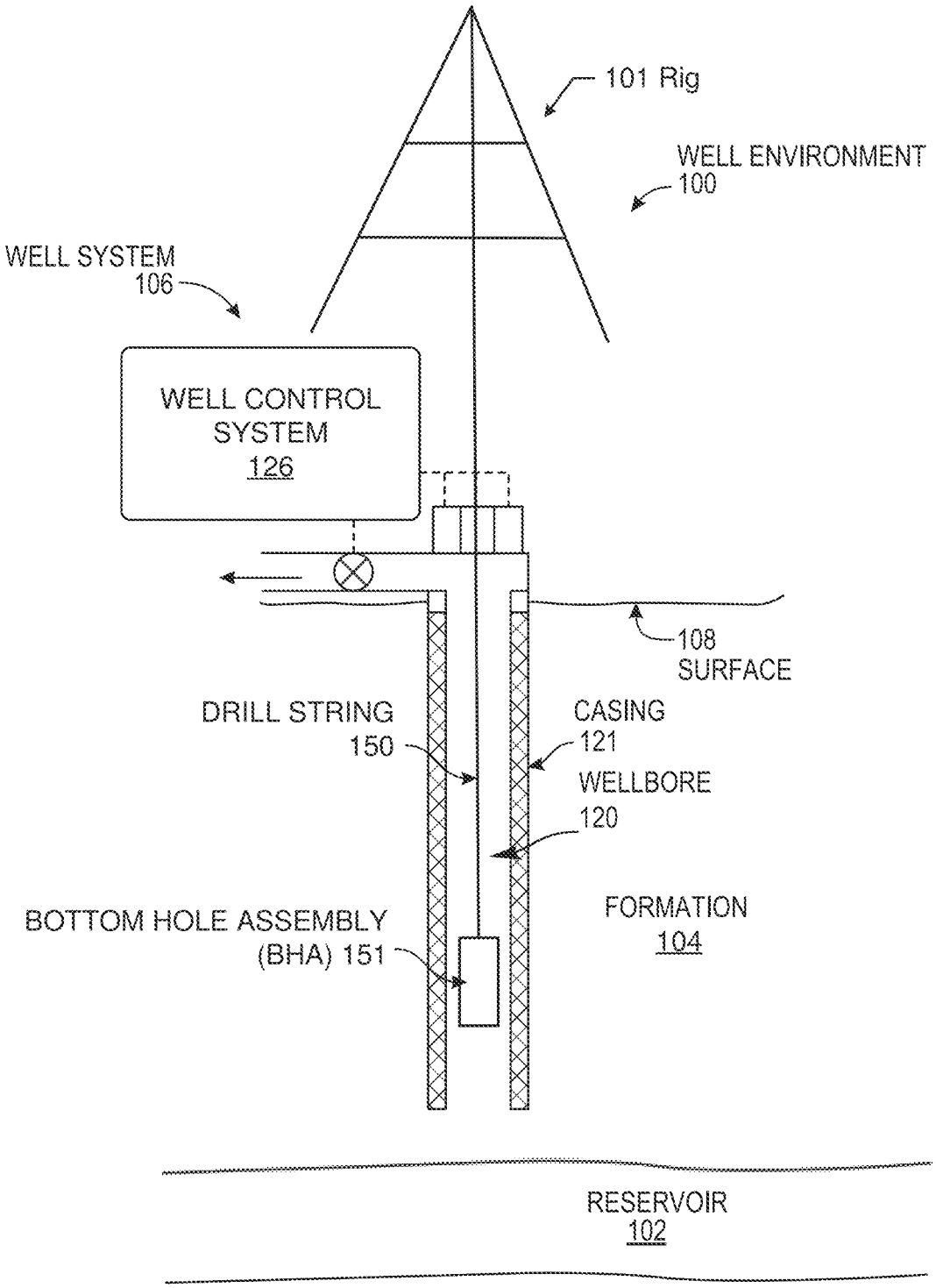
FIGS. 1A and 1B show systems in accordance with one or more embodiments.

FIG. 1A shows a schematic diagram in accordance with one or more embodiments. As shown in FIG. 1A, a well environment (100) includes a subterranean formation ("formation") (104) and a well system (106). The formation (104) may include a porous or fractured rock formation that resides underground, beneath the earth's surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120) with a casing (121), and a well control system (126). The well control system (126) may control various operations of the well system (106), such as well production operations, well drilling operation, well completion operations, well maintenance operations, and reservoir monitoring, assessment and development operations. In one or more embodiments, the well control system (126) performs these functionalities using the method described in reference to FIG. 2 below. In some embodiments, the well control system (126) includes a computer system, such as a portion of the computing system described in reference to FIG. 4 below.

The rig (101) is the machine used to drill a borehole to form the wellbore (120). Major components of the rig (101) include the drilling fluid tanks, the drilling fluid pumps (e.g., rig mixing pumps), the derrick or mast, the draw works, the rotary table or top drive, the drill string, the power generation equipment and auxiliary equipment. Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit cool and clean during drilling, carrying out drill cuttings, and suspending the drill cuttings while drilling is paused and when the drilling assembly is brought in and out of the borehole.

The wellbore (120) includes a bored hole (i.e., borehole) that extends from the surface (108) towards a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "downhole" end of the wellbore (120). The wellbore (120) may facilitate the circulation of drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of monitoring devices (e.g., logging tools) lowered into the formation (104) or the reservoir (102) during monitoring operations (e.g., during in situ logging operations).

In some embodiments, the well system (106) is provided with a bottom hole assembly (BHA) (151) attached to the drill string (150) to suspend into the wellbore (120) for performing the well drilling operation. The bottom hole assembly (BHA) is the lowest part of a drill string and includes the drill bit, drill collar, stabilizer, mud motor, etc.

Figure 1B:
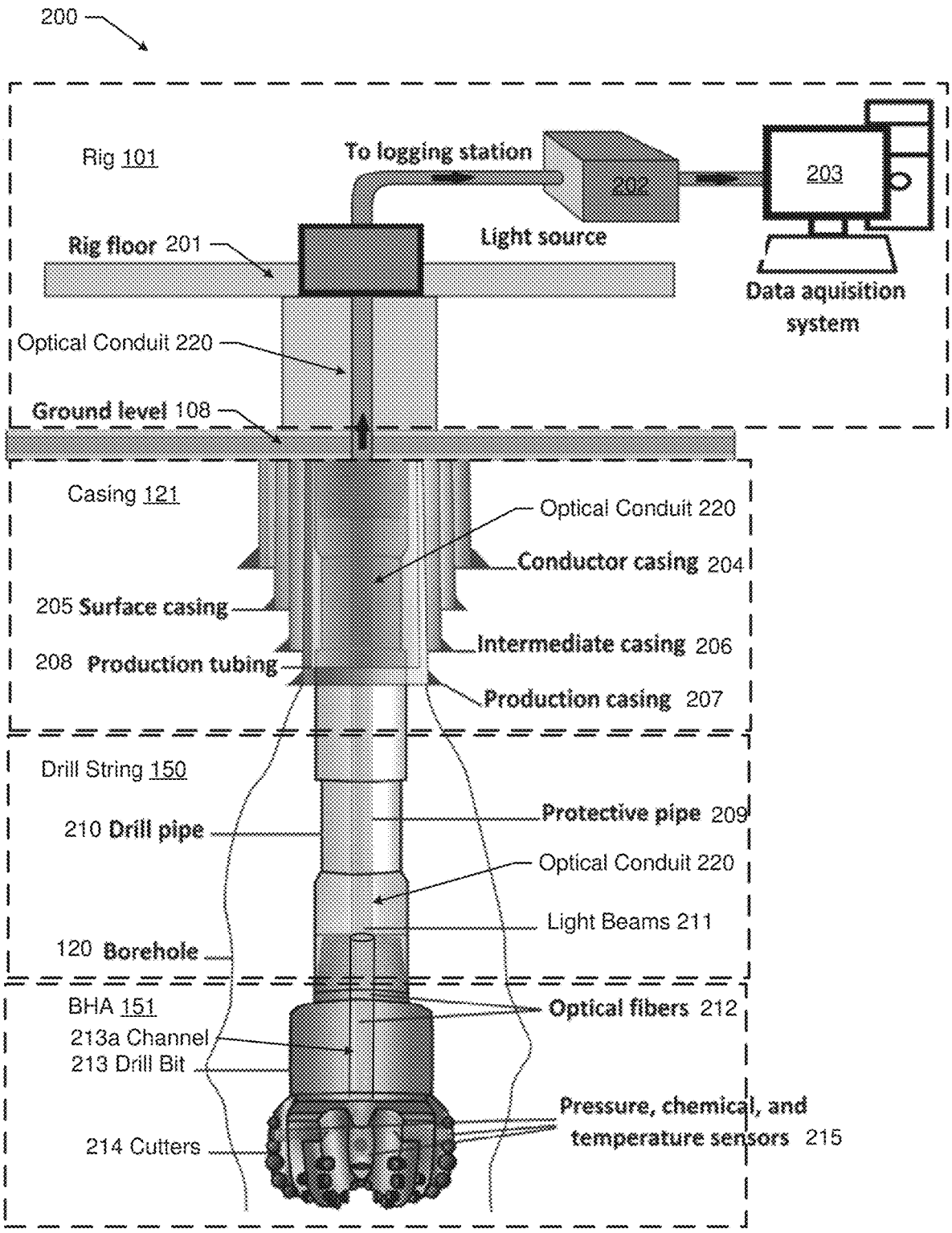

Turning to FIG. 1B, FIG. 1B illustrates a drilling configuration (200) of the well system (106) depicted in FIG. 1A above. In one or more embodiments, one or more of the modules and/or elements shown in FIG. 1B may be omitted, repeated, combined and/or substituted. Accordingly, embodiments disclosed herein should not be considered limited to the specific arrangements of modules and/or elements shown in FIG. 1B.

In the drilling configuration (200), an optical conduit (220) extends upward from the surface (108) (i.e., ground level) through a rig floor (201) of the rig (101) to a logging station that includes a light source (202) and a data acquisition system (203). The data acquisition system (203) may be part of, or separate from, the well control system (126) depicted in FIG. 1A above. The optical conduit (220) further extends downward through the casing (121) and drill string (150) to the BHA (151). Along and inside the optical conduit (220), a protective pipe (209) encloses optical fibers (212) within which the light beams (211) travel bi-directionally between the logging station and the BHA (151). Specifically, opposite ends of the optical fibers (212) are coupled respectively to the logging station and optical fiber-based sensors (e.g., the pressure, chemical, and temperature sensors (215)) of the BHA (151) for transmitting the light beams (211) there-between. In one or more embodiments, the sensors (215) are fiber optic shape sensor (FOSSs) to prevent any fiber's twisting or breaking while the sensors (215) and the light source (202) in the surface logging station on the rig floor (201) are rotating with the drill bit (213). FOSSs utilize fiber optic sensors to realise the orientation and position of the optical fiber relative to its starting point or realising the shape of an object with embedded FOSs. The FOSSs are mainly designed based on directional strain measurements. In general, FOSSs hold many distinct practical advantages over their conventional counterparts, such as:

- FOSSs can be monitored simply by a single remote interrogator unit, without complexity of wiring and connecting many sensors.
- There is no electricity required at the position of the sensor therefore they can be placed and the strain/bend can be measured in otherwise inaccessible places.
- Small dimensions of optical fibers (diameters between 100 μm and 2 mm) allow them to be embedded into very thin materials, surfaces/structures, or in the drill bit, which transforms the object into a self-sensing surface.
- Fiber optic sensors are immune to external electromagnetic fields.

Those skilled in the art will appreciate that the drill bit may include a single optical fiber-based sensor for measuring multiple downhole environment parameters, or multiple optical fiber-based sensors for each type of measurement desired.

As an example, the casing (121) includes one or more of a conductor casing (204), a surface casing, an intermediate casing (206), a production casing (207), and a production tubing (208) that are disposed concentrically within one another. The drill string (150) is suspended in the borehole (120) and includes the drill pipe (210) through which the conductive conduit (220) extends. The BHA (151) includes a drill bit (213) having cutters (214) and optical fiber-based sensors (i.e., pressure, chemical, and temperature sensors (215)) that are disposed on the exterior surface of the drill bit (213). The sensed information from the optical fiber-based sensors is transmitted to the logging station via the optical fibers (212). Within the drill bit (213), a channel (213*a*) is provided and coupled to the optical conduit (220) for routing the optical fibers (212) from the optical fiber-based sensors into the optical conduit (220). In this context, the channel (213*a*) within the drill bit (213) is referred to as the first channel and the optical conduit (220) passing through the drill string (150), the casing (121), and the rig (101) is referred to as the second channel. Further, the drill bit (213) is referred to as a smart sensing drill bit for measuring, in real-time during drilling, downhole environmental parameters, such as temperature, pressure, and chemical constituents.

In one or more embodiments, the optical fiber-based sensors (215) disposed on the external body of the drill bit (213) operate based on a fiber bragg grating mechanism. A Fiber Bragg grating (FBG) is inscribed in a photosensitive optical fiber by using an intense ultraviolet source, and may be between 1 and 10 mm long. FBG is a spatially limited periodic variation of the refractive index in the core. The periodic refractive index variation, leads to a similar effect as seen in atomic crystal layers: Bragg reflection at a wavelength related to the periodicity of the structure. The reflected wavelength will change if the periodicity or the refractive index changes. This feature enables the use of FBGs as sensors.

Only incident light intensity I at a particular wavelength $\lambda$ are reflected. This wavelength is proportional to the period d of the refractive index variation. A change in length of the fiber will change the periodicity to a value d', which leads to a corresponding change in reflected wavelength. Such a length change of the optical fiber is related to temperature T, but also to applied strain on the optical fiber. Pressure may be measured by connecting the FBG to a membrane (not shown). A chemical sensor may be created by coating the FBG with a polymer which exerts strain as a result of a chemical reaction with a specific chemical.

Based on the advantages attributed to optical fibers, the optical fiber-based sensors are electrically insulating, chemically inert, and highly sensitive to temperature and pressure change characteristics. Accordingly, the smart sensing drill bit can overcome the obstacles related to real time drilling under harsh conditions. In one or more embodiments, this smart drill-bit design possesses a dual function characteristic (drilling and scanning in the same time) which will result in enhancing the effectiveness of drilling operations.

Figure 2:
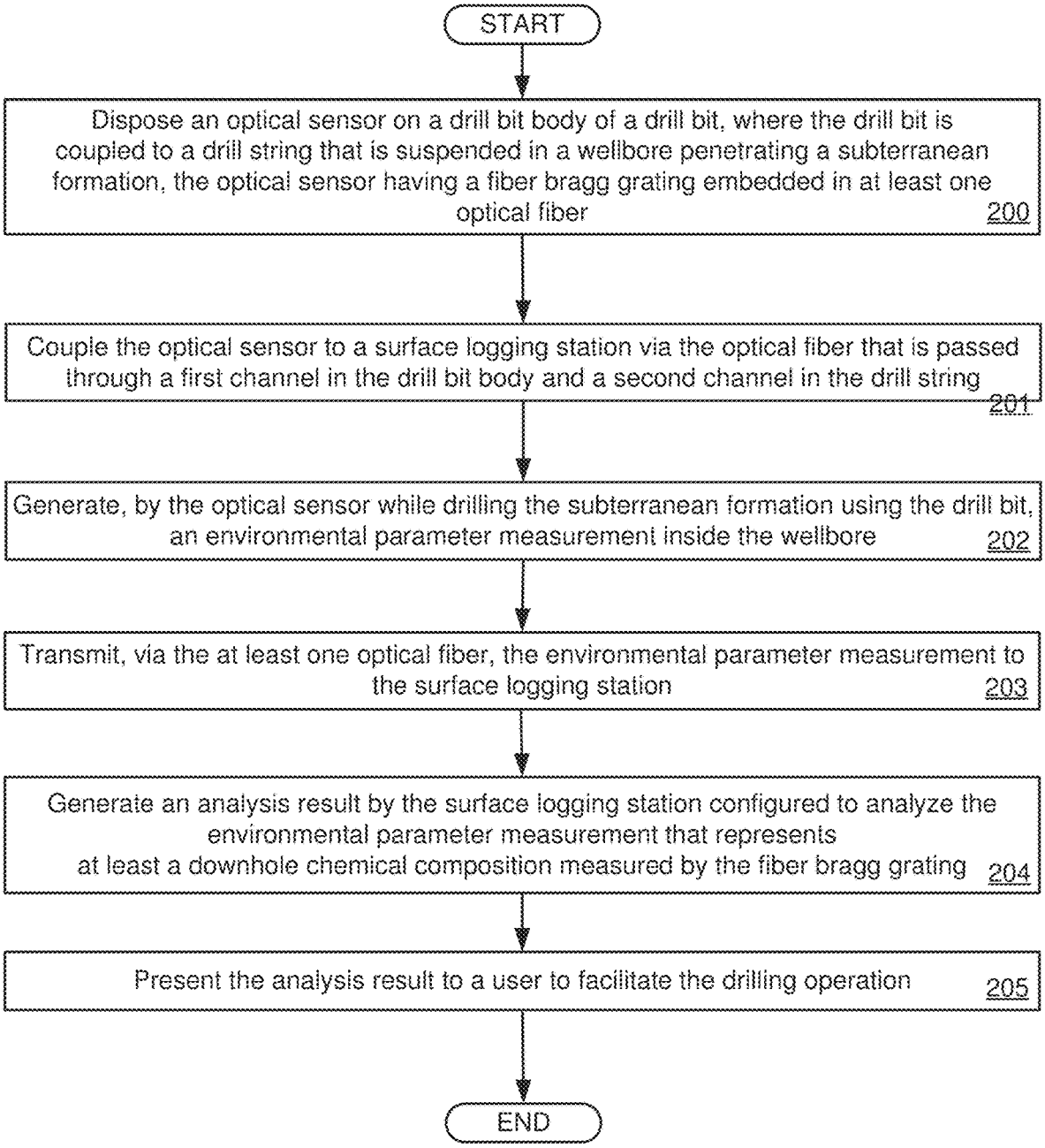
FIG. 2 shows a flowchart in accordance with one or more embodiments.

Turning to FIG. 2, FIG. 2 shows a process flowchart in accordance with one or more embodiments. Specifically, FIG. 2 describes a method for employing optical fiber sensors one or more blocks in FIG. 2 may be performed using one or more components as described in FIGS. 1A and 1B. While the various blocks in FIG. 2 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

Initially in Block 200, an optical sensor is disposed on a drill bit body of a drill bit, where the drill bit is coupled to a drill string that is suspended in a wellbore penetrating a subterranean formation. More specifically, one or more fiber-optic sensors are implanted into the external body of the rotating drill-bit. In one or more embodiments, a fiber bragg grating is embedded in a tip portion of an optical fiber to form the optical sensor. In particular, the tip portion is disposed at the surface of the drill bit body such that the fiber bragg grating is directly exposed to the downhole environment.

In Block 201, the optical sensor is coupled to a surface logging station via the optical fiber that is passed through a first channel in the drill bit body and a second channel in the drill string to couple to the surface logging station. In one or more embodiments, the optical fiber is coupled to a light source of the surface logging station where the light source generates an excitation light beam traveling downhole to the optical sensor. Because the light source and associated driving electronics are located at the surface without being subject to downhole environment, any disruption induced by light source failure to downhole environmental parameter measurement using the optical sensor is prevented.

In Block 202, while drilling the subterranean formation using the drill bit, an environmental parameter measurement inside the wellbore is generated by the optical sensor. In one or more embodiments, the environmental parameter measurement is generated as a reflected light beam by the fiber bragg grating of the optical sensor reflecting the excitation light beam. In particular, the environmental parameter measurement corresponds to a central wavelength of a spectral range of the reflected light beam, where the central wavelength is influenced by one or more of a downhole temperature, a downhole pressure, and a downhole chemical composition. Accordingly, the environmental parameter measurement represents at least a downhole chemical composition measured by the fiber bragg grating. Additional fiber bragg gratings may also be included in the optical sensor or separate optical sensors to generate other environmental parameter measurements, e.g., representing downhole pressure and/or temperature.

In Block 203, the environmental parameter measurement is transmitted via the optical fiber to the surface logging station. In one or more embodiments, the environmental parameter measurement is transmitted to the surface logging station via the reflected light beam travelling uphole in the optical fiber. Because the generation and transmission of the downhole environmental parameter measurement only involves passive components (i.e., optical fiber) without depending on any electronic components that are subject to downhole environment, any disruption induced by downhole electronic component failure to downhole environmental parameter measurement using the optical sensor is prevented.

In Block 204, an analysis result is generated by the surface logging station analyzing the environmental parameter measurement. In one or more embodiments, the analysis result is generated by at least the surface logging station measuring the central frequency of the reflected light beam to determine the downhole chemical composition. The analysis result may be further generated by the surface logging station measuring the central frequency of additional reflected light beams to determine the downhole temperature and/or the downhole pressure. Because measuring the reflected light beam is performed at the surface without subjecting any measurement electronics to downhole environment, any disruption induced by measurement electronic component failure to downhole environmental parameter measurement using the optical sensor is prevented.

In Block 205, the analysis result is presented to a user to facilitate the drilling operation. In one or more embodiments, the drilling parameters (e.g., rotational speed, weight-on-bit, rate of penetration, etc.) are adjusted based on the analysis result to optimize, or otherwise improve, the drilling operation. For example, the drilling parameters may be adjusted to minimize, or otherwise reduce, the effect of rapid frictional-temperature changes to control damages to the downhole tool and minimize hole-size calculation errors. In other words, the concurrent drilling and sensing operations described above enhance the effectiveness of the drilling operation. The environmental parameter measurement and corresponding analysis result that are generated while drilling contribute to accurate reservoir modelling to improve (i) the design of future drilling operations on the same field and reservoir to increase hydrocarbon production, (ii) the exploration of hydrocarbon resources that are difficult to recover due to challenging environments such as deep-water wells, and (iii) the ultimate recovery factor from existing fields.

Figure 3:
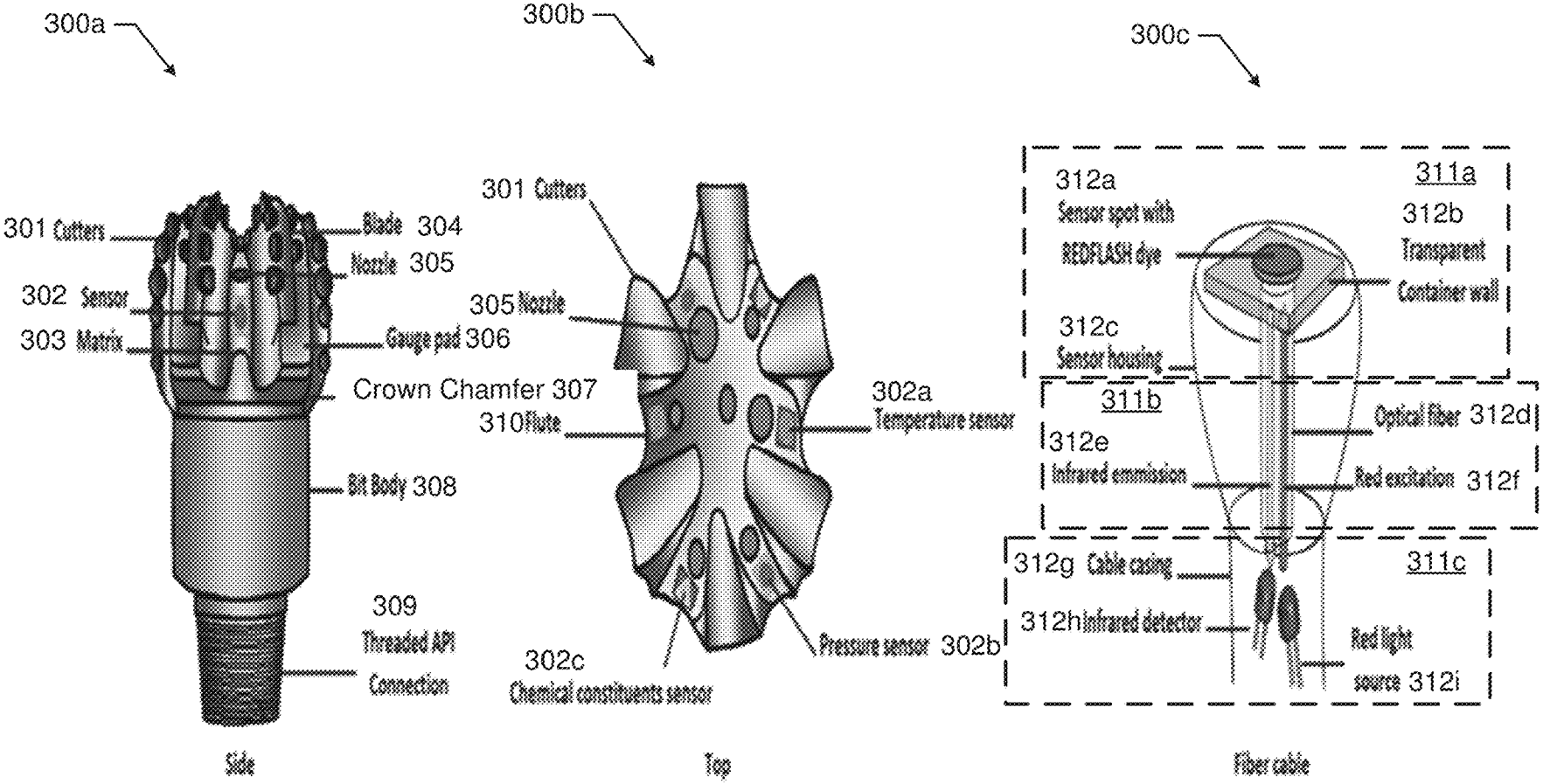
FIG. 3 shows an example in accordance with one or more embodiments.

FIG. 3 shows an example in accordance with one or more embodiments. The example shown in FIG. 3 is based on the system and method described in reference to FIGS. 1A-2 above. In particular, FIG. 3 shows an example smart sensing drill bit of the BHA (151) depicted in FIGS. 1A-1B above. In one or more embodiments, one or more of the modules and/or elements shown in FIG. 3 may be omitted, repeated, combined and/or substituted. Accordingly, embodiments disclosed herein should not be considered limited to the specific arrangements of modules and/or elements shown in FIG. 3.

As shown in FIG. 3, the side view (300*a*) and top view (300*b*) illustrate the exterior structure of the smart sensing drill bit. The exterior structure includes cutters (301) disposed on individual blades (e.g., blade (304)) protruding from a matrix (303) that extends from the bit body (308) via a crown chamfer (307). In addition to the matrix (303) and the crown chamfer (307), the bit body (308) is further provided with a threaded API connection (309) for connecting to a drill pipe, such as the drill pipe (210) depicted in FIG. 1B above. On the matrix (308), flutes (e.g., flute (310)) are formed as grooves between adjacent blades. One or more flutes are provided with a respective gauge pad (e.g., gauge pad (306)) where one or more optical sensors (e.g., a temperature sensor (302*a*), a pressure sensor (302*b*), a chemical constituents sensor (302*c*) are embedded or implanted. Further, one or more nozzles (e.g., nozzle (305)) are disposed on one or more flutes. For example, the nozzle (305) is a hole or opening for drilling fluid to exit. The pressure of the fluid inside the drill bit is usually high, leading to a high exit velocity through the nozzles that creates a high-velocity jet below the nozzles. This high-velocity jet of fluid cleans both the bit teeth and the bottom of the borehole. Pressure sensors (e.g., sensors (216)) around the nozzle can help to accurately estimate fluid pressure dropping, optimize fluid circulations, and identify the drilling problems such as bit nozzle(s) washout or plugging.

As shown in FIG. 3, the fiber cable (300*c*) includes a tip portion (311*a*), a length portion (311*b*), and an end portion (311*c*), and is placed in the optical conduit (220) depicted in FIG. 1B above. Specifically, the tip portion (311*a*) is embedded or implanted in the gauge pad (e.g., gauge pad (306)), and the length portion (311*b*) extends between the opposite ends of the optical conduit (220) such that the end portion (311*c*) connects to the logging station depicted in FIG. 1B above. While the oblong shape of the sensor housing (312*c*) extends into the length portion (311*b*) in the example shown in FIG. 3, in other examples the oblong shape of the sensor housing (312*c*) is limited to be only within the tip portion (311*a*) while the cable casing (312*g*) extends into and throughout the length portion (311*b*).

As noted above in reference to FIG. 1B, opposite ends of the optical fibers are coupled to the logging station and optical fiber-based sensors for transmitting the light beams there-between. In the example shown in FIG. 3, the optical fiber-based sensors are integrated within the optical fibers. Specifically, the tip portion (311*a*) includes a sensor spot (312*a*) mounted on a transparent container wall (312*b*) that terminates the optical fiber (312*d*) within the fiber cable (300*c*). In one or more embodiments of the invention, a FBG is engraved on the sensor spot (312*a*) that is separated from the tip of the optical fiber (312*d*) by the transparent container wall (312*b*). The transparent container wall (312*b*) is the upper part of FBG sensor that is made of transparent material. It has the ability to be transparent at all light-wavelengths and operate in extremes of pressure, temperature and chemically corrosive environments. The transparent container wall (312*b*) can be made of either Polycarbonate, Metal-oxides, Silicon, Glass Fiber Reinforced Polymer (GFRP) membrane or Glassy Polymer Cellulose Acetate (CA). The sensor spot (312*a*) and the transparent container wall (312*b*) are enclosed in a sensor housing (312*c*). The structure of the sensor housing (312*c*) includes the sensor spot (312*a*), transparent container wall (312*b*), and sensor cuvette. The sensor spot (312*a*) is coated with the redflash dye. Redflash technology is based on the unique analyte-sensitive redflash sensor materials. The redflash dye is excitable with red light and display an analyte-dependent luminescence in the near infrared (NIR). This excitation with red light significantly reduces interferences caused by auto-fluorescent samples and decreases photobleaching to a minimum. The sensor spot (312*a*) may have standard diameters of 5 mm or 8 mm and can also be obtained with an optical isolation (black coating). The sensor spot (312*a*) has a rough sensing surface (SF) which is whitish green and facing towards the side of the packaging. The backside (BS) of the sensor spot (312*a*) is smooth, shiny and dark green. The sensor spots can be glued with their backside on transparent, clean and dry inner container wall (wall thickness 0-6 mm) using an appropriate adhesive (e.g., transparent silicone based on acetic acid). After the glue has dried the gas or liquid sample has to be filled into the container so that the whitish-green sensing surface of the sensor spot is completely covered and in contact with the sample. The sensor cuvette is standard plastic cuvettes (10×10×45 cm) with a sensor spot glued to one side wall of the cuvette. The end portion (311*c*) includes a red light source (312*i*) and an infrared detector (312*h*) that correspond to an example of the light source (202) and data acquisition system (203), respectively, depicted in FIG. 1B above. For example, the red light source (312*i*) produces red excitation (312*f*) that travels within the optical fiber (312*d*) from the end portion (311*c*) to the sensor spot (312*a*) in the tip portion (311*a*). The optical fiber (312*d*) corresponds to an example of the optical fibers (212) depicted in FIG. 1B above. The cable casing (312*g*) provides environmental protection to the optical fiber (312*d*) throughout the length portion (311*b*). The infrared detector (312*h*) detects the infrared emission (312*e*) that is the reflected light of the red excitation (312*f*) reflected from the sensor spot (312*a*). In particular, the red excitation (312*f*) and the infrared emission (312*e*) travel in opposite directions within the optical fiber (312*d*).

In one or more embodiments, the sensor spot (312*a*) includes a fiber bragg grating (FBG), which is a periodic variation of the refractive index of the core of the optical fiber (312*d*) in the longitudinal direction. The FBG reflects light in a narrow spectral wavelength range with the central wavelength (referred to as the FBG wavelength) being directly proportional to the spatial period of the variation in refractive index. The spatial period is influenced by both longitudinal and radial strain in the optical fiber. The longitudinal strain is the dominant effect, stretching the optical fiber and thereby enlarging the grating's spatial period. In this regard, the FBG wavelength is a function of the exerted strain. Hence, FBGs can be used as sensors to measure a range of environmental parameters that induce strain in the optical fiber. Examples include measurement of temperature, pressure, chemical concentration, and acoustic noise as a result of fluid flow. Multiple sensors may be incorporated onto a single optical fiber by, e.g., wavelength division multiplexing (WDM), using FBGs with different central wavelengths for each of the sensors.

The passive nature of the optical fiber-based sensors shown in FIG. 3 contributes to a longer service lifetime compared to commonly used electronic downhole sensors. In addition, the optical fiber-based sensors shown in FIG. 3 do not cause electro-magnetic interference (EMI) to, or are effected by EMI from other downhole equipment such as electrical pumps. The component cost of the simple fiber cable construction shown in FIG. 3 provides significant potential for a lower-cost sensor solution compared to electrical downhole sensors, especially in combination with volume-produced optical fibers from the telecommunications industry. The logging station for the optical fiber-based sensors shown in FIG. 3 may be shared by a multiple wells to further reduce the initial hardware cost and ongoing maintenance cost.

Based on the foregoing, the smart sensing drill bit equipped with the optical fiber-based sensors has the following advantages: (1) small size for downhole application, (2) ability to be used in harsh environment under the effect of aggressive chemicals, in combination with considerable temperatures and pressures, (3) low expected risk and high reliability especially when the sensors are in contact with inflammable and pressurized hydrocarbons in the downhole zones, and (4) highly accurate measurement data obtained by the optical fiber-based sensors can be used to enhance safety by providing information about the subsurface conditions and the integrity of the well. The smart rotating drill-bit (based on fiber optic sensing technology) presented in embodiments disclosed herein is tailored to upstream applications. For example, the smart rotating drill-bit can help to increase the hydrocarbon production by optimizing the well design via accurate reservoir modelling as the era of "easy oil" is over and easily drillable sources of light-oil are becoming increasingly scarce. Also, embodiments disclosed herein help to improve the exploring of hydrocarbon resources that are more difficult to recover due to challenging environments such as deep-water wells. Lastly, significant benefit can come from increasing the ultimate recovery from existing fields. Only a fraction of this oil, the recovery factor, can be recovered and is considered to be a reserve. The portion that is not recoverable is not included unless and until additional and often newly developed methods are implemented to produce it. However, the smart drilling rotating drill-bit can lead to significant benefits: for example, an improvement of the recovery factor by only 2% can be equated to approximately one year of today's global oil demand. Hence it is obvious that to maximize production and meet growing energy demand in a sustainable way, the efficient management and optimization of production operations and systems is crucial.

Figure 4:
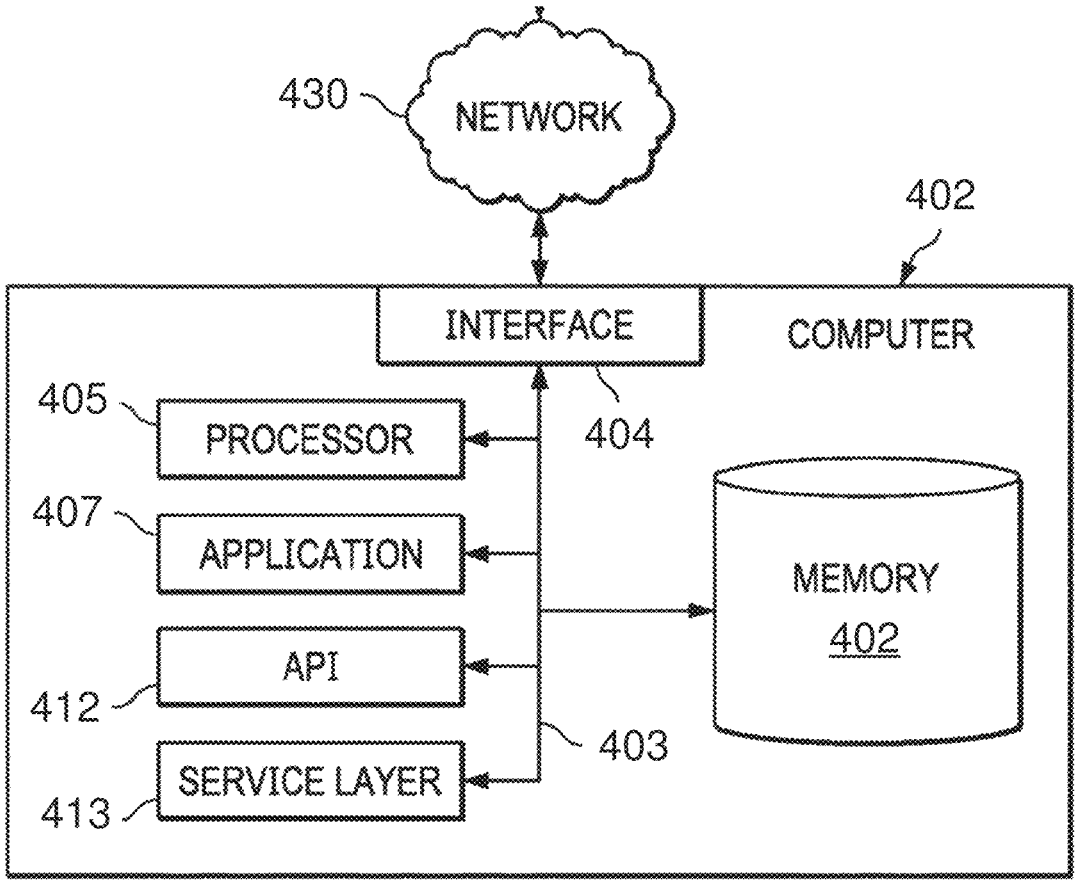
FIG. 4 shows a computing system in accordance with one or more embodiments.

Embodiments may be implemented on a computer system. FIG. 4 is a block diagram of a computer system (402) used to provide computational functionalities associated with described algorithms, methods, functions, processes, flows, and procedures as described in the instant disclosure, according to an implementation. The illustrated computer (402) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or other suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing computer (402), each computer (402) communicating over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

In some embodiments, the computer (402) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed is:

1. A drill bit for drilling a subterranean formation, comprising:

a drill bit body;

at least one cutting element disposed on the drill bit body; and an optical sensor disposed on the drill bit body and configured to generate an environmental parameter measurement while drilling the subterranean formation, the optical sensor comprising a first fiber bragg grating embedded in at least one optical fiber, the drill bit body adapted for coupling to a drill string and comprising a first channel for passing the at least one optical fiber into a second channel in the drill string, wherein the at least one optical fiber is adapted to pass through the first channel and the second channel to couple to a surface logging station for analyzing the environmental parameter measurement, wherein the first fiber bragg grating is embedded in the at least one optical fiber via a transparent container wall, wherein the transparent container wall terminates the at least one optical fiber, wherein the environmental parameter measurement represents at least a downhole chemical composition measured by the first fiber bragg grating, and wherein an analysis result of the surface logging station is presented to a user to facilitate a drilling operation.

2. The drill bit of claim 1, the optical sensor further comprising:

a second fiber bragg grating embedded in the at least one optical fiber, wherein the environmental parameter measurement further represents a downhole temperature measured by the second fiber bragg grating.

3. The drill bit of claim 2, the optical sensor further comprising:

a third fiber bragg grating embedded in the at least one optical fiber, wherein the environmental parameter measurement further represents a downhole pressure measured by the third fiber bragg grating.

4. The drill bit of claim 3, the at least one optical fiber comprising:

a first optical fiber comprising the first fiber bragg grating;

a second optical fiber comprising the second fiber bragg grating; and a third optical fiber comprising the third fiber bragg grating.

5. The drill bit of claim 1, wherein the drill bit body comprises a matrix portion, wherein the at least one cutting element is disposed on at least one of a plurality of blades protruding from the matrix portion, and wherein the optical sensor is embedded in a gauge pad disposed between two adjacent blades of the plurality of blades.

6. The drill bit of claim 1, wherein the first fiber bragg grating reflects an excitation light beam to generate a reflected light beam, wherein the excitation light beam is generated by a light source of the surface logging station and transmitted downhole via the at least one optical fiber, wherein the reflected light beam is transmitted to the surface logging station via the at least one optical fiber, wherein the environmental parameter measurement corresponds to a central wavelength of a spectral range of the reflected light beam, and wherein the central wavelength is influenced by one or more of a downhole temperature, a downhole pressure, and the downhole chemical composition.

7. A well system for performing a drilling operation of a subterranean formation, comprising:

a drill bit coupled to a drill string that is suspended in a wellbore penetrating the subterranean formation; and a surface logging station coupled to the drill bit via at least one optical fiber and configured to analyze an environmental parameter measurement inside the wellbore, wherein the drill bit comprises:

a drill bit body;

at least one cutting element disposed on the drill bit body; and an optical sensor disposed on the drill bit body and configured to generate an environmental parameter measurement while drilling the subterranean formation, the optical sensor comprising a first fiber bragg grating embedded in at least one optical fiber, the drill bit body adapted for coupling to the drill string and comprising a first channel for passing the at least one optical fiber into a second channel in the drill string, wherein the at least one optical fiber is adapted to pass through the first channel and the second channel to couple to the surface logging station for analyzing the environmental parameter measurement, wherein the first fiber bragg grating is embedded in the at least one optical fiber via a transparent container wall, wherein the transparent container wall terminates the at least one optical fiber, wherein the environmental parameter measurement represents at least a downhole chemical composition measured by the first fiber bragg grating, and wherein an analysis result of the surface logging station is presented to a user to facilitate the drilling operation.

8. The well system of claim 7, the optical sensor further comprising:

a second fiber bragg grating embedded in the at least one optical fiber, wherein the environmental parameter measurement further represents a downhole temperature measured by the second fiber bragg grating.

9. The well system of claim 8, the optical sensor further comprising:

a third fiber bragg grating embedded in the at least one optical fiber, wherein the environmental parameter measurement further represents a downhole pressure measured by the third fiber bragg grating.

10. The well system of claim 9, the at least one optical fiber comprising:

a first optical fiber comprising the first fiber bragg grating;

a second optical fiber comprising the second fiber bragg grating; and a third optical fiber comprising the third fiber bragg grating.

11. The well system of claim 7, wherein the drill bit body comprises a matrix portion, wherein the at least one cutting element is disposed on at least one of a plurality of blades protruding from the matrix portion, and wherein the optical sensor is embedded in a gauge pad disposed between two adjacent blades of the plurality of blades.

12. The well system of claim 7, wherein the first fiber bragg grating reflects an excitation light beam to generate a reflected light beam, wherein the excitation light beam is generated by a light source of the surface logging station and transmitted downhole via the at least one optical fiber, wherein the reflected light beam is transmitted to the surface logging station via the at least one optical fiber, wherein the environmental parameter measurement corresponds to a central wavelength of a spectral range of the reflected light beam, and wherein the central wavelength is influenced by one or more of a downhole temperature, a downhole pressure, and the downhole chemical composition.

13. A method for performing a drilling operation of a subterranean formation, comprising:

disposing an optical sensor on a drill bit body of a drill bit, wherein the drill bit is coupled to a drill string that is suspended in a wellbore penetrating the subterranean formation, the optical sensor comprising a fiber bragg grating embedded in at least one optical fiber;

coupling the optical sensor to a surface logging station via the at least one optical fiber that is passed through a first channel in the drill bit body and a second channel in the drill string to couple to the surface logging station;

generating, by the optical sensor while drilling the subterranean formation using the drill bit, an environmental parameter measurement inside the wellbore;

eliminating any downhole light source for the at least one optical fiber;

preventing disruption induced by any downhole light source failure to generating the environmental parameter measurement using the optical sensor, wherein generating the environmental parameter measurement comprises:

generating, by the fiber bragg grating reflecting an excitation light beam, a reflected light beam, wherein the excitation light beam is generated by a light source of the surface logging station and transmitted downhole via the at least one optical fiber; and wherein the environmental parameter measurement is transmitted to the surface logging station via the reflected light beam travelling within the at least one optical fiber, wherein the environmental parameter measurement corresponds to a central wavelength of a spectral range of the reflected light beam, and wherein the central wavelength is influenced by one or more of a downhole temperature, a downhole pressure, and the downhole chemical composition;

transmitting, via the at least one optical fiber, the environmental parameter measurement to the surface logging station;

generating, by the surface logging station, an analysis result by analyzing the environmental parameter measurement; and presenting the analysis result to a user to facilitate the drilling operation, wherein the environmental parameter measurement represents at least a downhole chemical composition measured by the first fiber bragg grating.

14. The method of claim 13, wherein the environmental parameter measurement further represents one or more of a downhole pressure and a downhole temperature measured by additional fiber bragg gratings of the optical sensor.

15. The method of claim 13, further comprising:

eliminating any downhole electronic component associated with the at least one optical fiber; and preventing disruption induced by any downhole electronic component failure to generating the environmental parameter measurement using the optical sensor.

* * * * *